US008109601B2

(12) United States Patent
Takada

(10) Patent No.: US 8,109,601 B2
(45) Date of Patent: Feb. 7, 2012

(54) PRINTER

(75) Inventor: Masanori Takada, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 921 days.

(21) Appl. No.: 12/100,857

(22) Filed: Apr. 10, 2008

(65) Prior Publication Data

US 2008/0259117 A1 Oct. 23, 2008

(30) Foreign Application Priority Data

Apr. 20, 2007 (JP) ..... 2007-111465

(51) Int. Cl.
*B41J 2/165* (2006.01)

(52) U.S. Cl. ..... 347/36; 347/35; 347/32

(58) Field of Classification Search ..... 347/20–23, 347/35–37

See application file for complete search history.

(56) References Cited

U.S. PATENT DOCUMENTS 5,500,659 A * 3/1996 Curran et al. ..... 347/28
7,530,664 B2 * 5/2009 Shimazaki et al. ..... 347/32

FOREIGN PATENT DOCUMENTS

JP 2002-79692 3/2002

* cited by examiner

*Primary Examiner* — Jason Uhlenhake

(74) *Attorney, Agent, or Firm* — Ditthavong Mori & Steiner, P.C.

(57) ABSTRACT

A printer including a medium supporting member that supports a print medium in a state placed thereon, a print head that has nozzles for ejecting ink droplets downward and freely reciprocates above the medium supporting member, and a maintenance device. The maintenance device is disposed to face the lower surface of the print head when the print head is in a standby position and receives residual ink in the nozzles which is ejected from the nozzles when the print head is in the standby position. The maintenance device has an ink receiving chamber that opens upward for receiving the residual ink ejected from the nozzles and a liquid injection member that injects liquid into the ink receiving chamber when the print head is away from a position where the print head faces the ink receiving chamber in the vertical direction.

20 Claims, 7 Drawing Sheets

PRINTER

CROSS-REFERENCE TO RELATED APPLICATION

The present application claims priority to Japanese Application No. 2007-111465, filed on Apr. 20, 2007, the entire contents of which are herein incorporated by reference.

BACKGROUND OF THE INVENTION

1. Field of the Invention

The present invention relates to printers for printing on a print medium by ejecting ink droplets on the print medium, and maintenance devices for such printers.

2. Discussion of the Background

One type of printer is configured as an apparatus that includes a print head with nozzles for ejecting ink droplets, and which prints by reciprocating the print head along a guide rail in left-and-right directions on a print medium and ejecting ink droplets through the nozzles to the print medium. Such a printer can be provided near an end of the guide rail with a maintenance device for performing maintenance on the nozzles. The maintenance device is placed at a position where the print head stands by during no printing operation of the printer (hereinafter, called a "standby position") and is provided with an ink receiving chamber that opens at its upper surface facing the nozzles.

Since ink remains at an end of the nozzle for a long period of time when the print head is in the standby position, the ink may solidify so that the nozzle end becomes clogged. In order to prevent such clogging, a residual ink is ejected from the nozzle to the ink receiving chamber at certain intervals of time. During this procedure, the ejected residual ink is received by the ink receiving chamber and is sent to a waste liquid tank, where the ink is collected in the waste liquid tank. When a certain amount of residual ink is collected, the waste liquid tank is detached from the printer and the residual ink is discarded and thus wasted. Such a printer configuration as mentioned above is shown in JP-A-2002-79692, for example.

However, problems associated with such a waste liquid tank configuration have been identified.

SUMMARY OF THE INVENTION

In one aspect of the present invention, a printer is provided that includes a medium supporting member configured to support a print medium, where the medium supporting member has a predetermined width in a left-right direction, a print head disposed to face the medium supporting member in a vertical direction, and a maintenance device disposed to face a lower surface of the print head when the print head is in a first position at one end of a reciprocating movement of the print head. The print head has nozzles for ejecting ink droplets downward, and the print head is configured to freely reciprocate above the medium supporting member in the left-right direction. The printer is configured to print on the print medium by ejecting printing ink droplets from the nozzles to the print medium while reciprocating the print head. The maintenance device is configured to receive residual ink ejected from the nozzles when the print head is in the first position. The maintenance device includes an ink receiving chamber configured to open upward to receive the residual ink ejected from the nozzles, and a liquid injection member configured to inject liquid into the ink receiving chamber when the print head is away from the first position where the print head faces the ink receiving chamber in the vertical direction.

In another aspect of the invention, a printer is provided that includes a medium supporting member configured to support a print medium, a print head disposed to face the medium supporting member, and a maintenance device including an ink receiving chamber disposed to face a lower surface of the print head when the print head is in a first position along the width of the medium supporting member. The print head has nozzles for ejecting ink droplets toward the medium supporting member, and the print head is configured to reciprocate across a width of the medium supporting member. The ink receiving chamber is configured to receive residual ink ejected from the nozzles when the print head is in the first position, and the maintenance device further includes a liquid injection member configured to inject liquid into the ink receiving chamber when the print head is away from the first position.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which.

DETAILED DESCRIPTION OF EMBODIMENTS OF THE INVENTION

Figure 1:
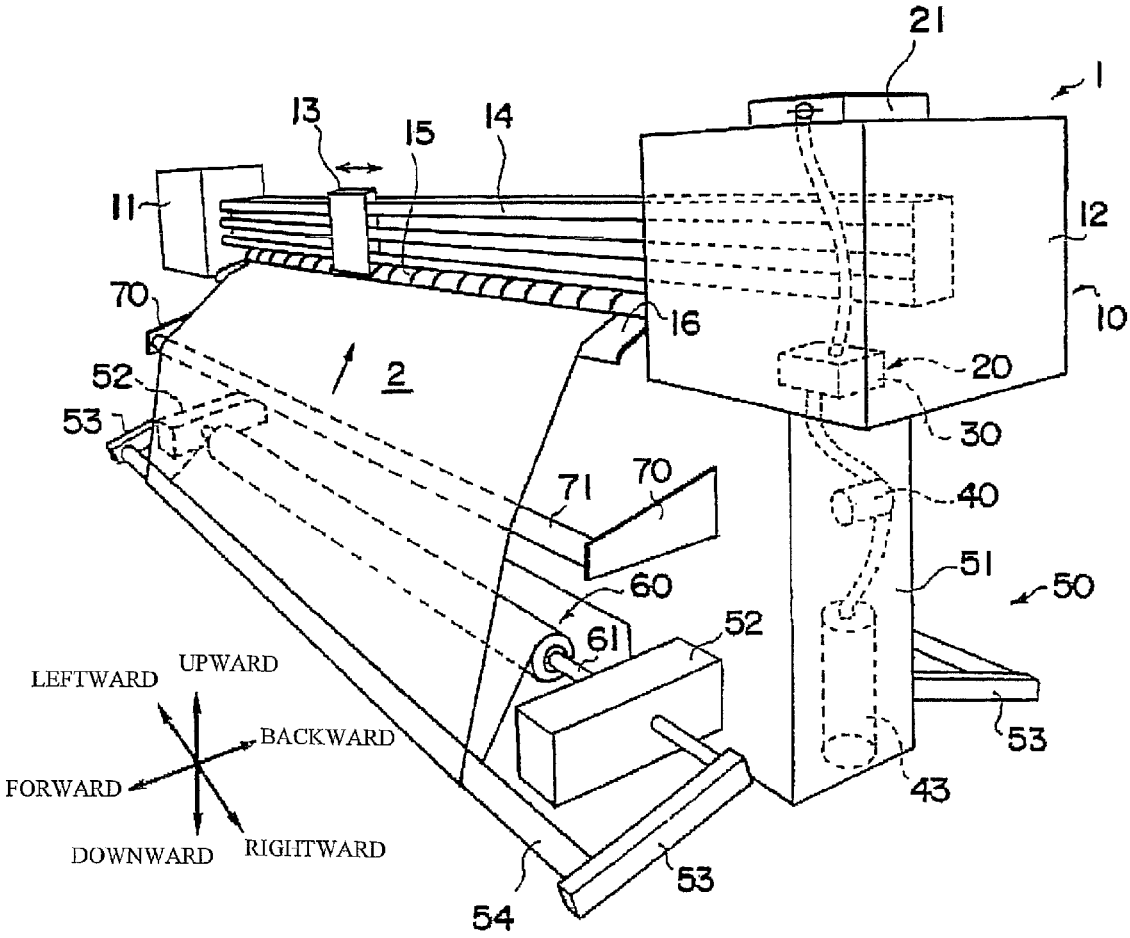
FIG. 1 is a perspective view showing a printer according to an embodiment of the present invention.

Embodiments of the present invention will be described hereinafter with reference to the accompanying drawings. In the following description, the constituent elements having substantially the same function and arrangement are denoted by the same reference numerals, and repetitive descriptions will be made only when necessary.

As noted above, problems associated with related art waste liquid tank configurations have been identified. For example, when a tube or the like is used to send the residual ink received by the ink receiving chamber to the waste liquid tank, the ink can become solidified inside the tube and the tube can become clogged according to the inner diameter and the length of the tube, so that it is difficult to send the residual ink to the waste liquid tank.

According to an aspect of the invention, the present invention addresses the aforementioned problem.

The present invention generally relates to a printer for printing on a print medium by ejecting ink droplets on the print medium. According to an aspect of the invention, a printer is provided having a maintenance device that is placed near an end of the printer for performing maintenance for nozzles, and in which residual ink received by an ink receiving chamber can be sent to the waste liquid tank without solidification of the ink.

In an embodiment of the invention, a printer is provided that includes: a medium supporting member which supports a print medium, having a predetermined width in the left-right direction, in a state placed thereon; a print head which is disposed to face the medium supporting member in the vertical direction, has nozzles for ejecting ink droplets downward, and freely reciprocates above the medium supporting member in the width direction; and a maintenance device which is disposed to face a lower surface of the print head when the print head is in a position at one end of its reciprocating movement and receives residual ink in the nozzles which is ejected from the nozzles when the print head is in the position at one end of its reciprocating movement. The printer conducts intended printing on the print medium by ejecting printing ink droplets from the nozzles to the print medium with reciprocating the print head. The maintenance device has an ink receiving chamber which opens upward to receive the residual ink ejected from the nozzles, and a liquid injection member which injects liquid into the ink receiving chamber when the print head is away from a position where the print head faces the ink receiving chamber in the vertical direction.

In a printer having the aforementioned structure, it is preferable that the maintenance device has an evacuating means which evacuates the liquid injection member, placed above the ink receiving chamber, out of the position above the ink receiving member when the print head moves to the one end of its reciprocating movement.

According to such an embodiment, since the maintenance device has the liquid injection member for injecting liquid into the ink receiving chamber so that the residual ink and the injected liquid are mixed in the ink receiving chamber, the concentration of the residual ink in the ink receiving chamber can be reduced so that the residual ink is hardly solidified, and the viscosity of the residual ink is lowered so that the residual ink easily flows, thereby facilitating the residual ink discharging outside from the ink receiving chamber.

Furthermore, since the maintenance device preferably has an evacuating means for evacuating the liquid injection member from the position above the ink receiving chamber when the print head is returned from the position above the medium supporting member to the standby position. Accordingly, when the residual ink is ejected from the nozzles while the print head is in the standby position, the residual ink ejected is not interfered with the liquid injection member and is thus prevented from scattering, thereby further ensuring the receiving of the residual ink by the ink receiving chamber. Further, the liquid injection member is therefore prevented from being contaminated with the residual ink, thereby decreasing the frequency of cleaning of the maintenance device and thus improving the workability of the printer. Furthermore, even when the liquid injection member and the lower surface of the print head are placed at positions of interfering with each other in the vertical direction, the liquid injection member is evacuated out of the area where the print head passes by the evacuating means and is not interfered with the print head, thereby achieving safe operation of the printer. Moreover, the liquid injection member and the lower surface of the print head can be designed to have a smaller distance therebetween in the vertical direction, thereby enabling the reduction in size of the printer.

Hereinafter, a preferred embodiment of a printer 1 according to the present invention will be described with reference to FIG. 1 through FIG. 7. For ease of explanation, leftward (left), rightward (right), forward (front), backward (rear), upward and downward directions (sometime referred to as a vertical direction) are defined by the directions of arrows shown in FIG. 1.

As shown in FIG. 1, the printer 1 is a printing apparatus for printing by ejecting liquid ink droplets to a sheet-like print medium 2, which is carried in a state wound into a roll. The printer 1 includes a printing section 10 for conducting the printing process which is disposed in an upper portion of the printer 1, and a retaining section 50 which is disposed in a lower portion of the printer 1.

The printing section 10 mainly includes a left storage housing 11, a right storage housing 12, a print head 13, a guide rail 14, a holding member 15, and a platen (or medium supporting member) 16. The guide rail 14 extends in the left-right direction for a length longer than the width of the print medium 2 such that the left and right ends of the guide rail 14 are housed in the left storage housing 11 and the right storage housing 12, respectively. The guide rail 14 is provided with grooves that are formed in its front surface to extend in the left-right direction for limiting movement in the forward, backward, upward, and downward directions of the print head 13.

The print head 13 has convexes formed on its rear surface that are slidably engaged with the grooves formed in the front surface of the guide rail 14, whereby the print head 13 can freely reciprocate in the left-right direction along the guide rail 14. The print head 13 is provided inside thereof with a plurality of nozzles (not shown), which are arranged to face downward to eject liquid ink droplets, supplied from a plurality of ink cartridges (not shown), to the print medium 2 on the platen 16 so that the nozzles face the print medium 2. The print head 13 is provided with a slide projection 13*a* (see FIGS. 2-5), which projects rightward from the right surface of the print head 13 and has a substantially triangular shape, as seen from above as shown in FIG. 3, and has a predetermined width in the vertical direction. Formed on the rear surface of the slide projection 13*a* is a slide slant face 13*b*, which is inclined from the left rear side to the right front side. The slide slant face 13*b* is adapted to come in contact with a contact column 32, as will be described later, in the vertical direction. When the print head 13 moves along the guide rail 14 to the right end portion (i.e., the "standby position"), the print head 13 and an ink receiving chamber 35 of a maintenance device 20, as will be described later, are adapted to face each other in the vertical direction. During printing operation, print ink droplets ejected from the nozzles pass through an ejecting opening 13*c* formed in the lower surface of the print head 13 and adhere to the print medium 2, thereby conducting the printing.

The left storage housing 11 is disposed at an upper left end of the printer 1 and is formed in a box-like shape to cover a left end portion of the guide rail 14. The right storage housing 12 is disposed at an upper right end of the printer 1 and is formed in a box-like shape to cover a right end portion of the guide rail 14. Placed inside the right storage housing 12 is the maintenance device 20. Installed in the left storage housing 11 and the right storage housing 12 are, for example, an operation panel for operating the printer 1 and ink cartridges in which ink to be ejected from the nozzles is stored, but not shown.

The platen 16 extends in the left-right direction for a length longer than the width of the print medium 2 and is disposed below the print head 13. As shown in FIG. 1, the platen 16 has slant surfaces at its both ends in the forward-backward direction so as to facilitate the feeding and discharging of the print medium 2 and has a surface facing the print head 13, which is parallel with the lower surface of the print head 13. The holding member 15 extends in the left-right direction for a length longer than the width of the print medium 2 and is disposed below the guide rail 14. The holding member 15 is positioned at the back of the print head 13 and has a rotational roller (not shown) that is at the lower end of the holding member 15 to come in contact with the print medium 2. In addition, the holding member 15 is arranged movably in the vertical direction. Therefore, the holding member 15 moves downward so that the rotational roller presses the print medium 2 on the platen 16 from above, thereby regulating the movement of the print medium 2 in the feeding direction (shown by an arrow in FIG. 1).

Figure 2:
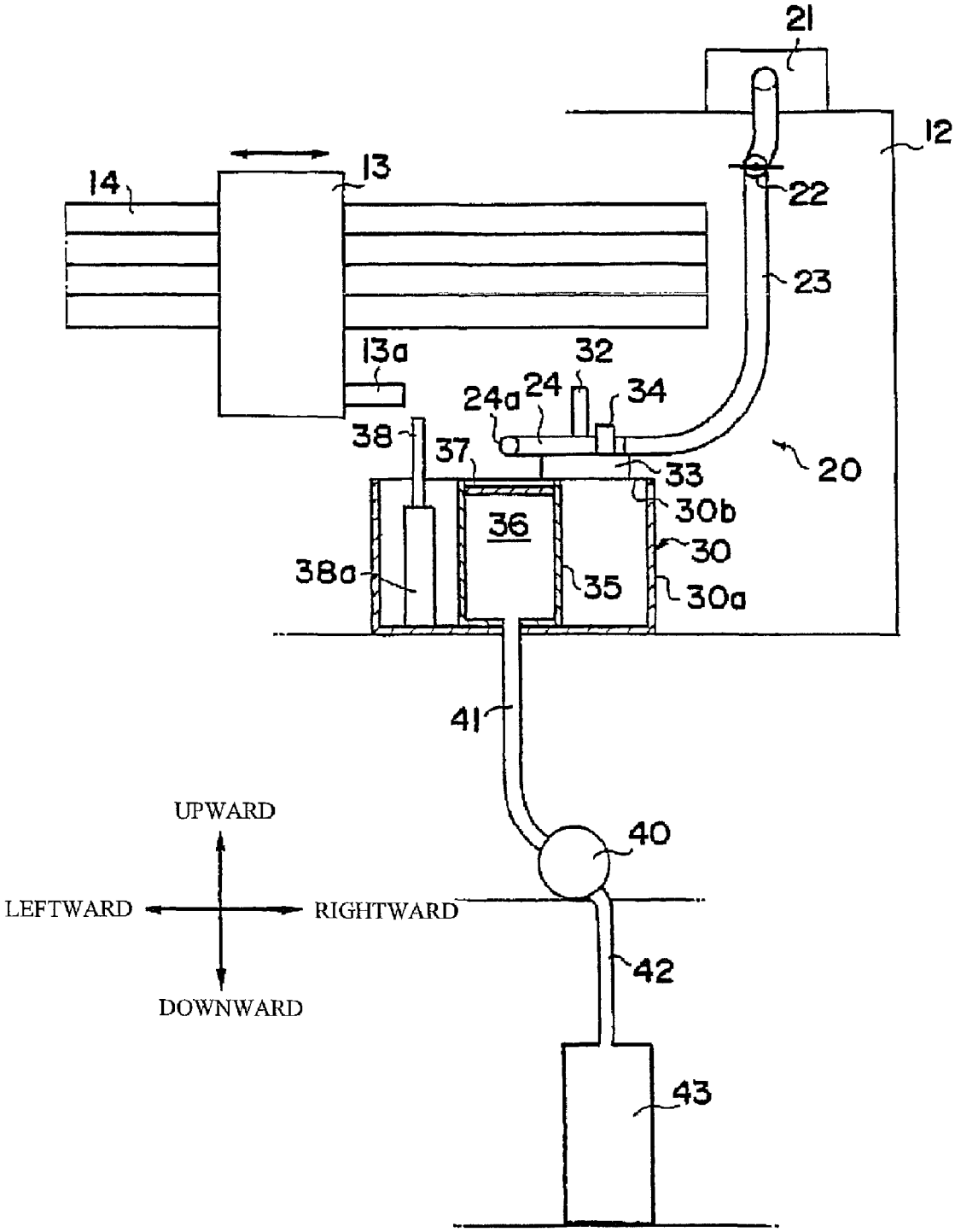
FIG. 2 is a side view showing a print head and a maintenance device according to an embodiment of the invention.
Figure 3:
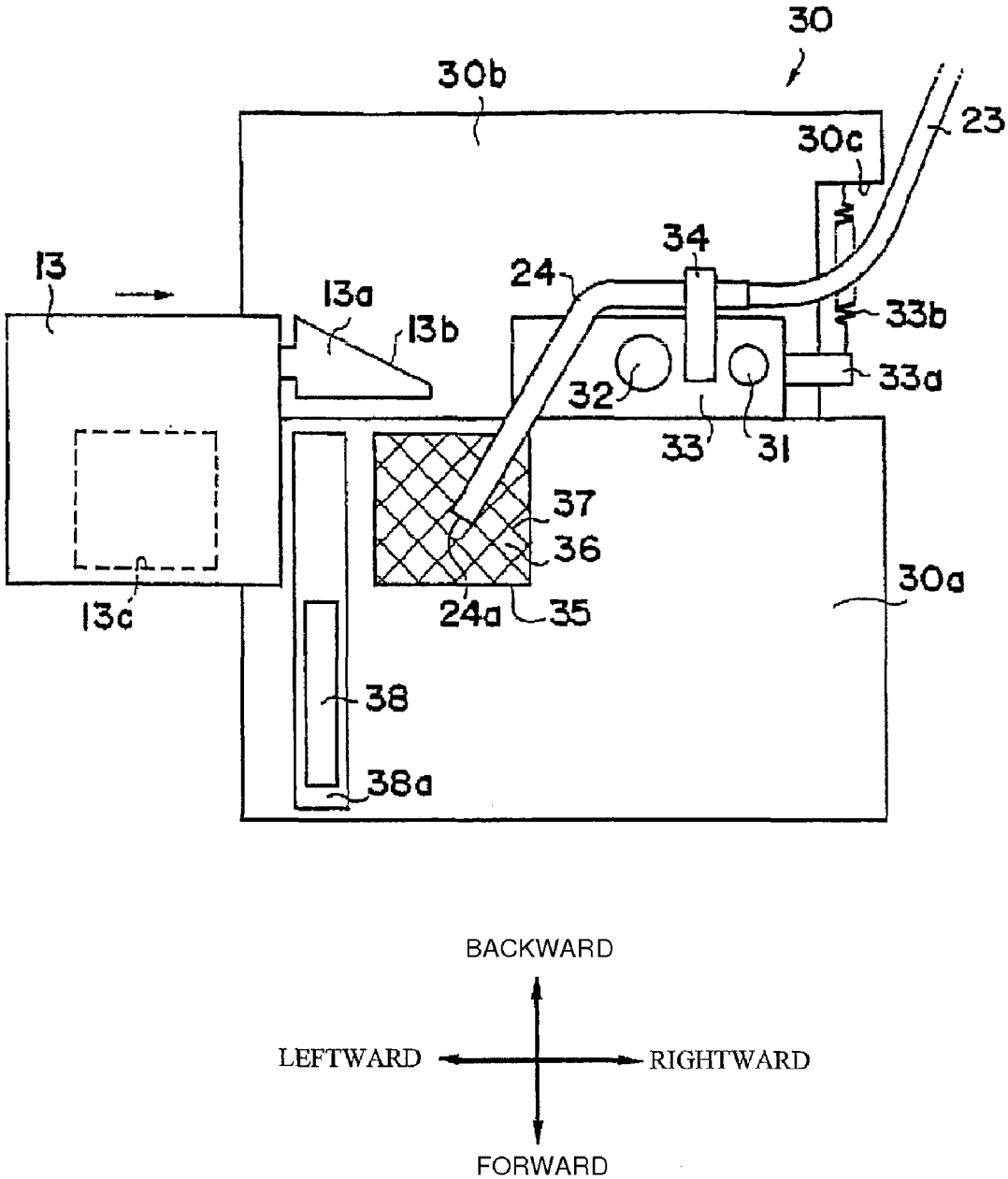
FIG. 3 is a plan view showing the maintenance device and the print head.

As shown in FIGS. 1 and 2, the maintenance device 20 mainly includes a cleaning solution cartridge 21, a supporting container 30, a swing member 33, an ink receiving chamber 35, a wiper 38, a drainage pump 40, and a waste liquid tank 43. The cleaning solution cartridge 21 is a cartridge containing cleaning solution, which is soluble in residual ink so as to decrease the concentration of the residual ink collected in the ink receiving chamber 35. The cleaning solution cartridge 21 is placed on the upper surface of the right storage housing 12. Further, the cleaning solution cartridge 21 is in communication with an end of a cleaning solution passage 23, which is, for example, a flexible tube made of a resin material. A control valve 22 is disposed near the upper end of the cleaning solution passage 23 to control the dropping of the cleaning solution by gravity from the cleaning solution cartridge 21.

The supporting container 30 is disposed inside the right storage housing 12 as shown in FIG. 1 and includes a supporting box 30*a*, which is made of, for example, a resin material to have a box-like shape that opens at its upper surface, and a supporting base 30*b*, which is made of, for example, a metallic material to have a plate-like shape that is disposed on a rear edge of the upper opening of the supporting box 30*a* and extends rearward. The supporting container 30 is disposed at such a vertical position that the upper opening does not interfere with the lower surface of the print head 13. In addition, the supporting base 30*b* has a cutout formed in a front portion of a right side and has a rear edge portion 30*c* at the rear end of the cutout.

The swing member 33 is made of, for example, a resin material to have a plate-like shape extending in the left-right direction, and has a rod-like return projection 33*a* extending in the right direction from the right surface of the swing member 33 as shown in FIG. 3. One end of a spring 33*b* is fixed to the right end of the return projection 33*a* and the other end of the spring 33*b* is fixed to the rear edge portion 30*c*. In the state the swing member 33 is mounted on the upper surface of the supporting base 30*b*, the supporting base 30*b* and the right end portion of the swing member 33 are connected by a pivot pin 31 so that the swing member 33 can freely swing in the forward-backward direction about the pivot pin 31. That is, as the swing member 33 is moved to swing rearward and then force of holding the swing member 33 in this state is removed, the swing member 33 returns to the position shown in FIG. 3 by spring force of the spring 33*b*. The swing member 33 is provided with the contact column 32 at a position about the center in the left-right direction of the swing member 33. The contact column 32 is formed in a column-like shape extending upward from the upper surface of the swing member 33.

Figure 6:
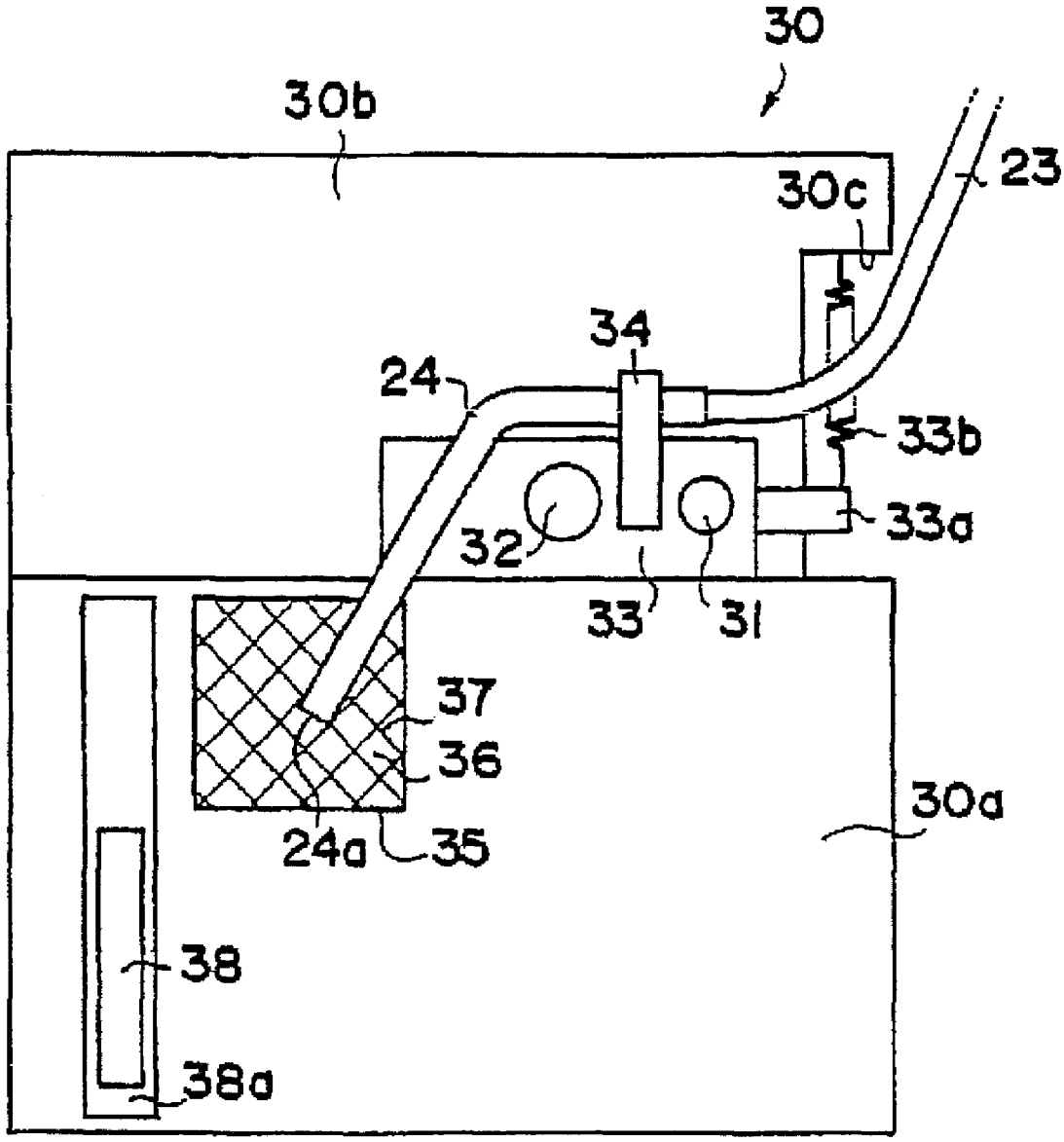
FIG. 6 is a plan view showing the maintenance device.
Figure 7:
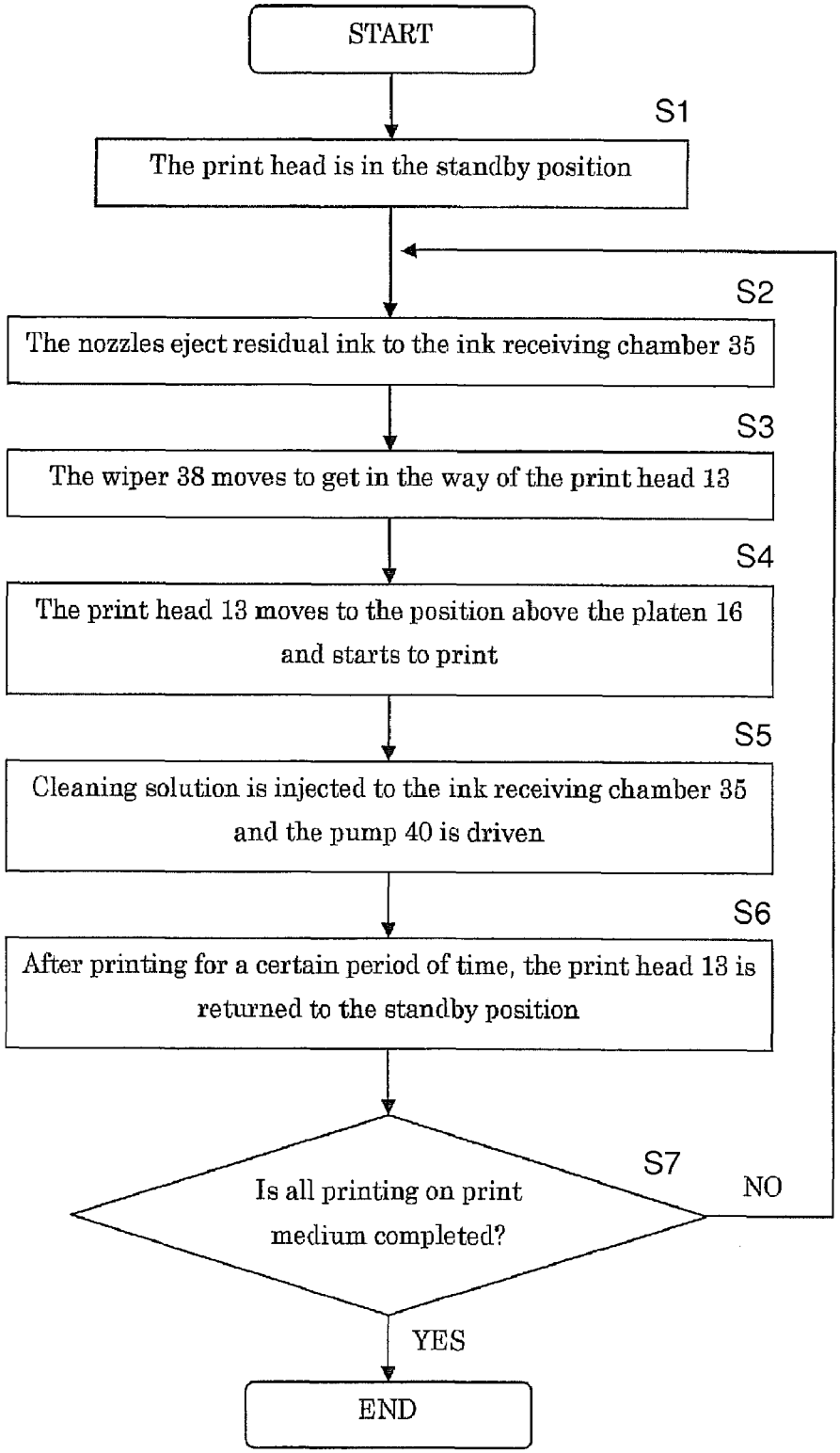
FIG. 7 is a flow chart showing the actions of the maintenance device and the print head.

Fixed to the upper surface of the swing member 33 is an end of a fixing member 34, which is formed in a plate shape, for example. On the other hand, at the other end of the fixing member 34, one end of an injection pipe (or liquid injection member) 24, which is made of a metal to have a tube-like shape and which is bent into substantially a V-like shape, is held by the fixing member 34 and is in communication with the lower end of the aforementioned cleaning solution passage 23. When the print head 13 is not in the standby position, an injection port 24*a* of the other end of the injection pipe 24 is adapted to be positioned near the center of the ink receiving chamber 35 as seen from above as shown in FIG. 6. The injection pipe 24 is placed below the lower surface of the print head 13 in the vertical direction not to interfere with the lower surface of the print head 13 as shown in FIG. 2.

The ink receiving chamber 35 is made of, for example, a resin material. As shown in FIG. 2, the ink receiving member 35 is formed in substantially a rectangular parallelepiped, which opens at its upper surface and is hollow, and is disposed inside the supporting box 30*a* such that the height of the upper opening of the ink receiving chamber 35 and the height of the upper opening of the supporting box 30*a* are substantially equal. Filled in the hollow portion inside the ink receiving chamber 35 is a porous absorbing member 36. Fixed to the ink receiving chamber 35 to cover the upper opening of the ink receiving chamber 35 is an upper frame 37 which is made of a metal to have a net-like structure such that the upper frame 37 is disposed on the absorbing member 36 from above. The upper frame 37 holds the absorbing member 36 not to project upward from the upper opening.

The wiper 38 is made of, for example, a resin material to have a plate-like shape extending in the forward-backward direction and is disposed at a vertical position capable of coming into contact with the lower surface of the print head 13. The wiper 38 is connected at its lower portion to a wiper driving member 38*a*, which is arranged inside the supporting box 30*a*. By the wiper driving member 38*a*, the wiper 38 can be reciprocated in the forward-backward direction as shown in FIG. 3. When the wiper 38 is moved to the rear side, the upper end of the wiper 38 can come in contact with the ejecting opening 13*c*.

A drainage pump 40 is a device for forcing liquid to enter or discharge by operation of the drainage pump 40 and is disposed inside the printer 1. As shown in FIG. 2, one end of a first discharge passage 41, which is made of, for example, a resin material to have a tube-like shape, is in communication with the opening formed in the bottom of the ink receiving chamber 35, and the other end of the first discharge passage 41 is in communication with the suction port of the drainage pump 40. On the other hand, one end of a second discharge passage 42, which is made of, for example, a resin material to have a tube-like shape, is in communication with the waste liquid tank 43, and the discharge port of the drainage pump 40 is in communication with the other end of the discharge passage 42. The waste liquid tank 43 is a tank having a hollow portion inside thereof and has an upper end in communication with the one end of the second discharge passage 42 so that liquid can enter into the waste liquid tank 43 through the second discharge passage 42 and can be stored in the waste liquid tank 43.

As shown in FIG. 1, the retaining section 50 mainly includes a base 51, supporting members 52, guide supporting arms 53, a first guide member 54, a sheet supplying member 60, fixing arms 70, and a second guide member 71. Further, the retaining section 50 has the same structure on the rear side as that on the front side. That is, the retaining section 50 has a sheet winding member (not shown) provided in a symmetrical position in the forward-backward direction to the sheet supplying member 60 on the front side. Therefore, explanation about the rear side of the retaining section 50 will be omitted.

The base 51 is formed substantially in a rectangular parallelepiped extending in the left-right direction for a length longer than the width of the print medium 2 to support the printing section 10, which is arranged above the base 51. The supporting members 52 are each formed substantially in a rectangular parallelepiped extending in the forward direction and the rear ends of the supporting members 52 are fixed to the base 51 at lower portions near the left and right ends of the base 51, respectively. The fixing arms 70 are each formed in a plate shape extending in the forward direction and the rear ends of the fixing arms 70 are fixed to the base 51 at portions substantially the same as the supporting members 52 in the left-right direction and above the supporting members 52.

As shown in FIG. 1, the first guide member 54 is made of, for example, a metallic material to have a cylindrical shape extending in the left-right direction for a length longer than the width of the print medium 2. Both ends of the guide member 54 in the left-right direction are rotatably supported by the front ends of the guide supporting arms 53. On the other hand, the rear ends of the guide supporting arms 53 are rotatably supported by the supporting members 52. According to this structure, the guide supporting arms 53 and the first guide member 54 can pivotally move in the vertical direction about the rear ends of the guide supporting arms 53.

The sheet supplying member 60 has a sheet supplying shaft 61 extending in the left-right direction onto which the unprinted print medium 2 is wound. The ends in the left-right direction of the sheet supplying shaft 61 are rotatably supported by the supporting members 52. At the portions of the sheet supplying shaft 61 supported by the supporting members 52, it is configured to apply rotational force to the sheet supplying shaft 61 and to brake the sheet supplying shaft 61 to prevent the sheet supplying shaft 61 from freely rotating.

The sheet winding member disposed on the rear surface of the base 51 includes a sheet winding shaft (not shown) extending in the left-right direction onto which the print medium 2 that has been printed upon is wound. The ends in the left-right direction of the sheet winding shaft are rotatably supported by supporting members (not shown). Similarly to the sheet supplying member 60 as mentioned above, at the portions of the sheet winding shaft supported by the supporting members, it is configured to apply rotational force to the sheet winding shaft and to brake the sheet winding shaft to prevent the sheet winding shaft from freely rotating.

The second guide member 71 is made of, for example, a metallic material to have a cylindrical shape extending in the left-right direction for a length longer than the width of the print medium 2 and has a smooth peripheral surface. The second guide member 71 is held and fixed at both ends thereof by the fixing arms 70 and the fixing arms 70 are disposed on the front surface of the base 51 so that the second guide member 71 can smoothly introduce the print medium 2 to the slant surface at the front end of the platen 16.

The structure of the inkjet printer 1 has been described above. Hereinafter, the actions of the print head 13 and the maintenance device 20 will be described with reference to a flow chart shown in FIG. 7.

Figure 5:
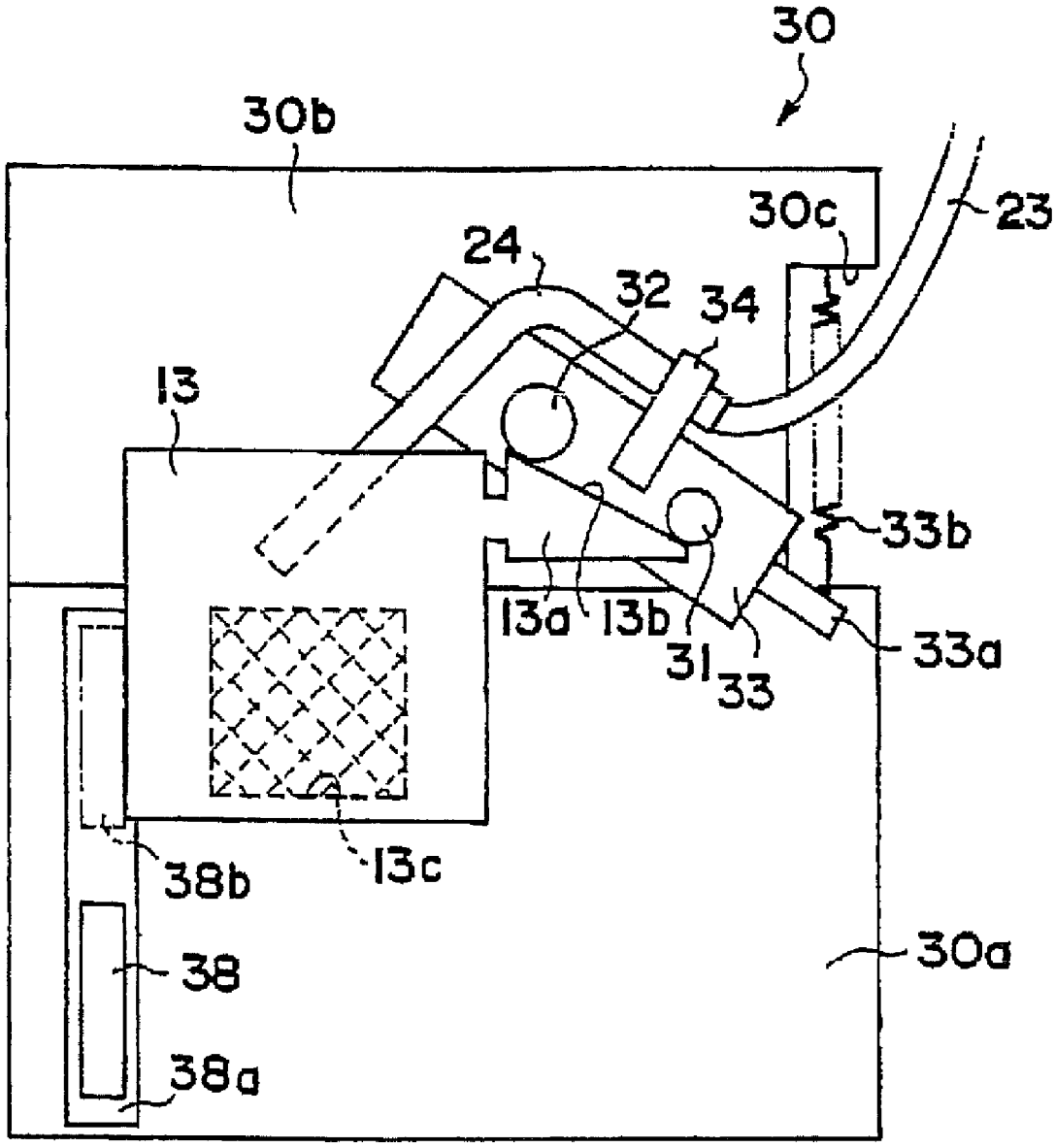
FIG. 5 is a plan view showing the maintenance device and the print head in a standby position.

First, in step S1, as shown in FIG. 5, the print head 13 is in the standby position at the right end of the guide rail 14. In this state, the contact column 32 comes in contact with the slide slant face 13*b* so that the swing member 33 swings backward together with the injection pipe 24 and the fixing member 34 about the pivot pin 31. Accordingly, the injection pipe 24 is evacuated to a position apart from the upper surface of the ink receiving chamber 35, while the ejecting opening 13*c* and the upper opening of the ink receiving chamber 35 are substantially overlapped as seen from the above. The return projection 33*a* swings forward about the pivot pin 31 so that the spring 33*b* is drawn forward and thus stores its biasing force. The wiper 38 is in a forward position as shown by solid lines. In this position, the wiper 38 is never in contact with the ejecting opening 13*c* even when the print head 13 moves leftward along the guide rail 14.

In step S2, in the state shown in FIG. 5, residual ink staying in the end portions of the nozzles are ejected to the ink receiving chamber 35 and is thus discharged. During this time, since the ejecting opening 13*c* and the upper opening of the ink receiving chamber 35 are substantially overlapped and the injection pipe 24 is evacuated from the upper surface of the ink receiving chamber 35 as mentioned above, the residual ink ejected is surely received by the ink receiving chamber 35. The discharged residual ink interpenetrates into the absorbing member 36, then flows downward in the ink receiving chamber 35, and becomes deposited on the bottom of the ink receiving chamber 35.

Then, the procedure proceeds to step S3. As shown in FIG. 5, the wiper 38 is moved to a position 38*b* shown by a two-dot chain line by the wiper driving member 38*a*. In this state, since the wiper 38*b* is in the position 38*b*, the ejecting opening 13*c* comes in contact with the end portion of the wiper 38 when the print head 13 moves leftward along the guide rail 14.

Then, in step S4, the print head 13 is moved leftward along the guide rail 14 from the standby position to start printing. During this, since the wiper 38 is in the position 38*b* shown by the two-dot chain line as shown in FIG. 5, the print head 13 is moved with its ejecting opening 13*c* coming in contact with the end of the wiper 38 whereby the residual ink adhering to portions around the ejecting opening 13*c* is wiped by the wiper 38. Therefore, printing ink ejected from the ejecting opening 13*c* is prevented from being mixed with residual ink, thereby improving the printing accuracy during printing.

Also in step S4, while the print head 13 is moved leftward from the standby position along the guide rail 14, the contact column 32, which is in contact with the slide slant face 13*b* because the contact column 32 is biased forward by the biasing force of the spring 33*b*, moves forward with keeping the contact state according to the slide slant face 13*b*, whereby the swing member 33 swings forward about the pivot pin 31 together with the injection pipe 24 and the fixing member 34. After that, as the print head 13 is moved leftward to such a position that the slide slant face 13*b* and the contact column 32 are not in contact with each other, the injection port 24*a* is positioned near the center of the upper opening of the ink receiving chamber 35 (see FIG. 3). The wiper 38 wipes the residual ink on the ejecting opening 13*c* while the print head 13 passes through above the wiper 38. After that, the wiper 38 is returned to the position 38 shown by the solid line by the wiper driving member 38*a*. The print head 13 moved to the position above the platen 16 is reciprocated in the left-right direction above the platen 16 and ejects printing ink droplets from the nozzles toward the print medium 2 while the print medium 2 is fed in the feeding direction, thereby conducting intended printing.

Then, the procedure proceeds to step S5. While the print head 13 conducts printing on the print medium 2, in the maintenance device 20 in the state shown in FIG. 6, first the control valve 22 is opened for a certain period of time, the cleaning solution flows by gravity from the cleaning solution cartridge 21 through the cleaning solution passage 23 to the injection pipe 24 and is then injected from the injection port 24*a* to a portion about the center of the upper opening of the ink receiving chamber 35. In this state, by opening the control valve 22 and driving the drainage pump 40 for a certain period of time, the residual ink and the cleaning solution deposited on the bottom of the ink receiving chamber 35 are forced to flow from a first discharge passage 41 to the drainage pump 40 and, after that, are forced to be discharged from the drainage pump 40 to the waste liquid tank 43 through a second discharge passage 42. It should be noted that the injection of the cleaning solution from the injection port 24*a* and the driving of the drainage pump 40 are terminated before proceeding to next step S6.

Figure 4:
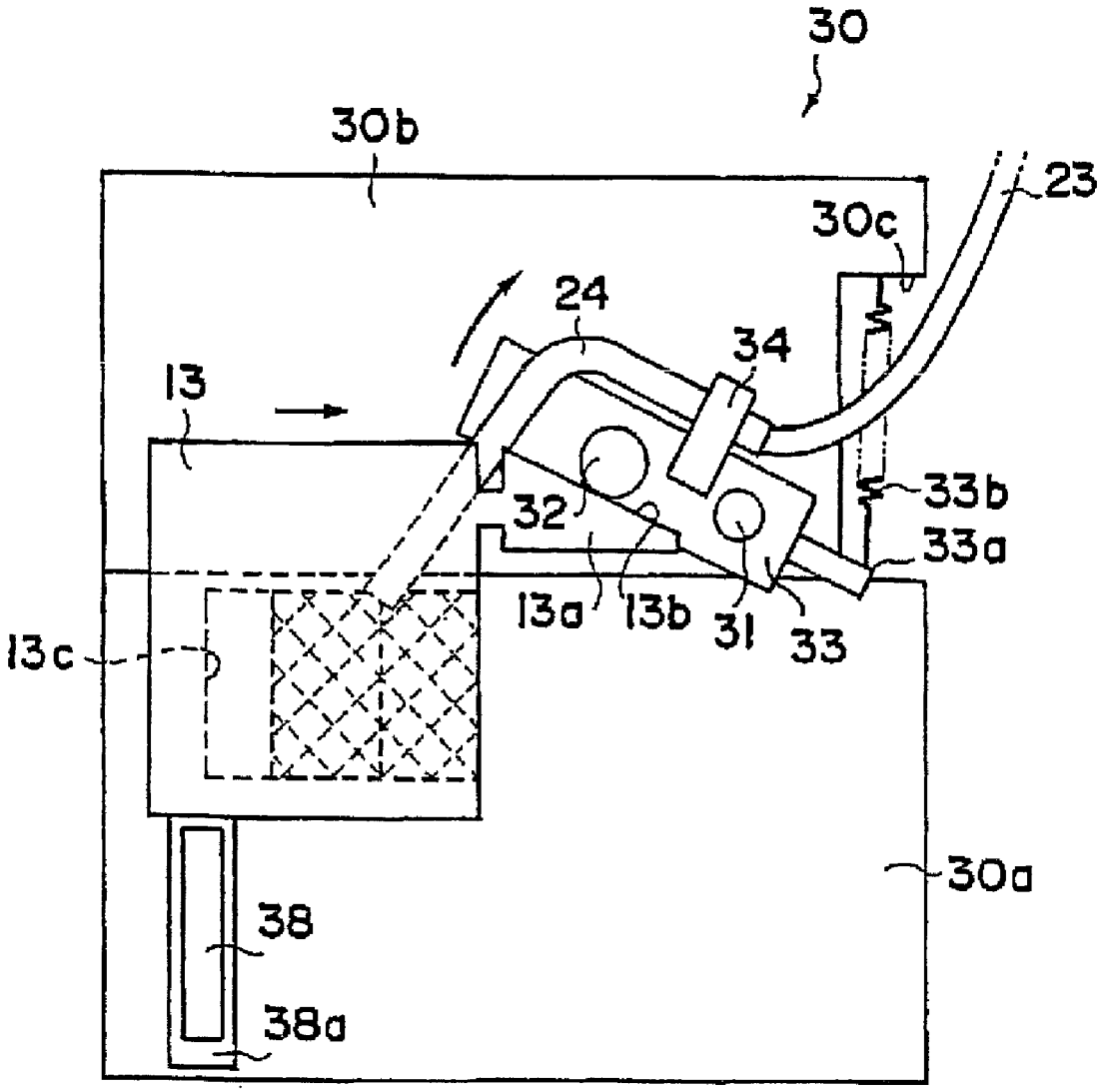
FIG. 4 is a plan view showing the maintenance device and the print head.

Then, in step S6, after printing on the print medium 2 for a certain period of time, the print head 13 is returned to the standby position at the right end. At this point, the state around the right end is moved from the state shown in FIG. 3 to the state shown in FIG. 4 and is further moved from the state shown in FIG. 4 to the state shown in FIG. 5 (standby position). This movement will be described step by step. First, the print head 13 is moved from the left side to the right side of the supporting container 30 toward the standby position as shown in FIG. 3. After that, the print head 13 is moved further from the state shown in FIG. 3 so that the slide slant face 13*b* comes in contact with the contact column 32. As the print head 13 is moved rightward further from this state, the contact column 32 is moved backward along the slide slant face 13*b* and the swing member 33 with the injection pipe 24 and the fixing member 34 swings backward about the pivot pin 31 as shown in FIG. 4. During this, the return projection 33*a* swings forward about the pivot pin 31 to stretch the spring 33*b*. After that, the print head 13 is further moved rightward and is therefore returned to the standby position shown in FIG. 5. In this state, the ejecting opening 13*c* and the upper opening of the ink receiving chamber 35 are substantially overlapped as seen from above. Since the detail of this state has been described above, explanation of this state will be omitted.

Then, the procedure proceeds to step S7. When it is determined that there is still a region where printing should be provided, the procedure returns to step S2. Until it is determined that all printing on the print medium 2 is completed, step S2 through step S6 are repeated. On the other hand, when it is determined that all printing on the print medium 2 is completed, the flow chart is terminated.

Hereinafter, the effects of the printer 1 according to the present invention will be summarized. First, by injecting cleaning solution into the ink receiving chamber 35, the concentration of the residual ink received by the ink receiving chamber 35 is reduced, thereby preventing the ink from being solidified inside the first discharge passage 41 and the second discharge passage 42 and ensuring the residual ink to be discharged outside from the ink receiving chamber 35. Since the concentration of the residual ink received by the ink receiving chamber 35 can be reduced, the ink is not solidified even when the first discharge passage 41 and the second discharge passage 42 are composed of piping materials having smaller diameter. Therefore, it is possible to reduce the manufacturing cost of the printer 1.

Secondly, the cleaning solution is injected to the center of the ink receiving chamber 35 using the injection pipe 24 so that the cleaning solution uniformly interpenetrates inside the ink receiving chamber 35, thereby reducing the concentration of the entire residual ink inside the ink receiving chamber 35. Therefore, the residual ink is prevented from being solidified inside the ink receiving chamber 35, thereby decreasing the frequency of cleaning of the ink receiving chamber 35 and improving the workability of the printer 1.

Thirdly, the slide projection 13*a* and the contact column 32 come in contact with each other when the print head 13 is in the standby position so as to move the swing member 33, whereby the injection pipe 24 is evacuated from the upper surface of the ink receiving chamber 35. Therefore, the evacuation of the injection pipe 24 is achieved by a reasonable and easy method without using, for example, a sensor, thereby reducing the manufacturing cost of the printer 1. Further, since the swing member 33 moved is adapted to be returned to the original position by the spring 33*b*, the swing member 33 can be returned to the original position by a reasonable and easy method without using, for example, a motor, thereby reducing the manufacturing cost of the printer 1.

In the aforementioned embodiment, the opening time period of the control valve 22 and the driving time period of the drainage pump 40 in step S5 may be freely set. However, it is preferable that the opening time period of the control valve 22 is set such that the cleaning solution can uniformly interpenetrate into the absorbing member 36 and the driving time period of the drainage pump 40 is set such that the residual ink and the cleaning solution deposited on the bottom of the ink receiving chamber 35 can be discharged to the waste liquid tank 43 without remaining inside the first discharge passage 41 and the second discharge passage 42.

Though the injection pipe 24 is evacuated from (or moved away from) the upper surface of the ink receiving chamber 35 by the swing action of the swing member 33, which is caused by the contact between the slide projection 13*a* and the contact column 32 in the aforementioned embodiment, means for evacuating the injection pipe 24 (or means for moving the injection pipe 24 away) from the upper surface of the ink receiving chamber 35 is not limited to that of the aforementioned embodiment.

Though the wiper 38 is adapted not to come in contact with the ejecting opening 13*c* when the print head 13 is returned to the standby position after printing for a certain period of time in the aforementioned embodiment, the wiper 38 can be adapted to come in contact with the ejecting opening 13*c* even when the print head 13 is returned to the standby position similarly to the case that the print head 13 is moved from the standby position to the position above the platen 16.

In the aforementioned embodiment, the lower surface of the print head 13 and the injection pipe 24 are adapted not to interfere with each other in the vertical direction. On the other hand, even when the lower surface of the print head 13 and the injection pipe 24 are adapted to interfere with each other, the interference between the injection pipe 24 and the print head 13 can be prevented by such an arrangement that the injection pipe 24 is evacuated completely out of the area where the print head 13 passes by an evacuating means. Therefore, in this case, the injection pipe 24 according to the present invention can be provided at a position above the ink receiving chamber 35.

It should be noted that the exemplary embodiments depicted and described herein set forth the preferred embodiments of the present invention, and are not meant to limit the scope of the claims hereto in any way. Numerous modifications and variations of the present invention are possible in light of the above teachings. It is therefore to be understood that, within the scope of the appended claims, the invention may be practiced otherwise than as specifically described herein.

What is claimed is:

1. A printer comprising:

a medium supporting member configured to support a print medium, said medium supporting member having a predetermined width in a left-right direction;

a print head disposed to face said medium supporting member in a vertical direction, said print head having nozzles for ejecting ink droplets downward, said print head being configured to freely reciprocate above said medium supporting member in the left-right direction; and a maintenance device disposed to face a lower surface of said print head when said print head is in a first position at one end of a reciprocating movement of said print head, said maintenance device being configured to receive residual ink ejected from said nozzles when said print head is in the first position, wherein said printer is configured to print on the print medium by ejecting printing ink droplets from said nozzles to the print medium while reciprocating said print head, and wherein said maintenance device includes:

an ink receiving chamber configured to open upward to receive the residual ink ejected from said nozzles; and a liquid injection member configured to inject liquid into said ink receiving chamber when said print head is away from the first position where said print head faces said ink receiving chamber in the vertical direction, wherein said liquid injection member is configured to pivot from a first orientation where an outlet of said liquid injection member is above an opening of said ink receiving chamber to a second orientation where said outlet is not above said opening.

2. The printer according to claim 1, wherein:

said liquid injection member is mounted to a swing member configured to pivot from the first orientation to the second orientation;

said liquid injection member being configured to inject liquid into said ink receiving chamber when in the first orientation; and said liquid injection member being configured to not inject liquid into said ink receiving chamber when in the second orientation.

3. The printer according to claim 2, wherein said liquid injection member is spring biased toward the first orientation.

4. The printer according to claim 3, wherein said liquid injection member is configured to be in the second orientation when said print head is in the first position.

5. The printer according to claim 2, wherein:

said print head includes a projection having a slant face that is inclined with respect to a reciprocation direction of said print head;

said swing member is configured to pivot about an axis that is substantially perpendicular to the reciprocation direction; and said slant face of said projection is configured to contact a contact member on said swing member as said print head moves along the reciprocation direction into the first position, such that the contact between said slant face and said contact member pivots said liquid injection member from the first orientation to the second orientation.

6. The printer according to claim 5, wherein a spring is provided to bias said liquid injection member toward the first orientation, and wherein said spring is configured to pivot said liquid injection member from the second orientation to the first orientation when said print head is moved out of the first position.

7. The printer according to claim 1, wherein said ink receiving chamber has a porous absorbing member provided therein.

8. The printer according to claim 1, wherein said maintenance device further includes a movable wiper configured to move from a first location where said movable wiper can contact a lower surface of said print head to a second location where said movable wiper cannot contact the lower surface of said print head.

9. The printer according to claim 8, wherein said movable wiper is configured to be in the first location when said print head moves out of the first position, and wherein said movable wiper is configured to be in the second position when said print head moves into the first position.

10. A printer comprising:

a medium supporting member configured to support a print medium, said medium supporting member having a predetermined width in a left-right direction;

a print head disposed to face said medium supporting member in a vertical direction, said print head having nozzles for ejecting ink droplets downward, said print head being configured to freely reciprocate above said medium supporting member in the left-right direction; and a maintenance device disposed to face a lower surface of said print head when said print head is in a first position at one end of a reciprocating movement of said print head, said maintenance device being configured to receive residual ink ejected from said nozzles when said print head is in the first position, wherein said printer is configured to print on the print medium by ejecting printing ink droplets from said nozzles to the print medium while reciprocating said print head, wherein said maintenance device includes:

an ink receiving chamber configured to open upward to receive the residual ink ejected from said nozzles; and a liquid injection member configured to inject liquid into said ink receiving chamber when said print head is away from the first position where said print head faces said ink receiving chamber in the vertical direction, wherein said liquid injection member is configured to inject liquid into said ink receiving chamber when said liquid injection member is in a second position above said ink receiving chamber, and wherein said maintenance device further includes an evacuating means for evacuating said liquid injection member out of the second position above said ink receiving chamber when said print head moves to the first position.

11. A printer comprising:

a medium supporting member configured to support a print medium;

a print head disposed to face said medium supporting member, said print head having nozzles for ejecting ink droplets toward said medium supporting member, said print head being configured to reciprocate across a width of said medium supporting member; and a maintenance device including an ink receiving chamber disposed to face a lower surface of said print head when said print head is in a first position along the width of said medium supporting member, said ink receiving chamber being configured to receive residual ink ejected from said nozzles when said print head is in the first position, said maintenance device further including a liquid injection member configured to inject liquid into said ink receiving chamber when said print head is away from the first position, wherein said liquid injection member is configured to pivot from a first orientation where an outlet of said liquid injection member is above an opening of said ink receiving chamber to a second orientation where said outlet is not above said opening.

12. The printer according to claim 11, wherein:

said liquid injection member is mounted to a swing member configured to pivot from the first orientation to the second orientation;

said liquid injection member being configured to inject liquid into said ink receiving chamber when in the first orientation; and said liquid injection member being configured to not inject liquid into said ink receiving chamber when in the second orientation.

13. The printer according to claim 12, wherein said liquid injection member is spring biased toward the first orientation.

14. The printer according to claim 13, wherein said liquid injection member is configured to be in the second orientation when said print head is in the first position.

15. The printer according to claim 12, wherein:

said print head includes a projection having a slant face that is inclined with respect to a reciprocation direction of said print head;

said swing member is configured to pivot about an axis that is substantially perpendicular to the reciprocation direction; and said slant face of said projection is configured to contact a contact member on said swing member as said print head moves along the reciprocation direction into the first position, such that the contact between said slant face and said contact member pivots said liquid injection member from the first orientation to the second orientation.

16. The printer according to claim 15, wherein a spring is provided to bias said liquid injection member toward the first orientation, and wherein said spring is configured to pivot said liquid injection member from the second orientation to the first orientation when said print head is moved out of the first position.

17. The printer according to claim 11, wherein said ink receiving chamber has a porous absorbing member provided therein.

18. The printer according to claim 11, wherein said maintenance device further includes a movable wiper configured to move from a first location where said movable wiper can contact a lower surface of said print head to a second location where said movable wiper cannot contact the lower surface of said print head.

19. The printer according to claim 18, wherein said movable wiper is configured to be in the first location when said print head moves out of the first position, and wherein said movable wiper is configured to be in the second position when said print head moves into the first position.

20. A printer comprising:

a medium supporting member configured to support a print medium;

a print head disposed to face said medium supporting member, said print head having nozzles for ejecting ink droplets toward said medium supporting member, said print head being configured to reciprocate across a width of said medium supporting member; and a maintenance device including an ink receiving chamber disposed to face a lower surface of said print head when said print head is in a first position along the width of said medium supporting member, said ink receiving chamber being configured to receive residual ink ejected from said nozzles when said print head is in the first position, said maintenance device further including a liquid injection member configured to inject liquid into said ink receiving chamber when said print head is away from the first position, wherein said liquid injection member is configured to inject liquid into said ink receiving chamber when said liquid injection member is in a second position above said ink receiving chamber, and wherein said maintenance device further includes an evacuating means for evacuating said liquid injection member out of the second position above said ink receiving chamber when said print head moves to the first position.

* * * * *